United States Patent [19]

Ricketts

[11] 4,359,246

[45] Nov. 16, 1982

[54] IN SITU OIL SHALE RETORT WITH NON-UNIFORMLY DISTRIBUTED VOID FRACTION

[75] Inventor: Thomas E. Ricketts, Grand Junction, Colo.

[73] Assignee: Occidental Oil Shale, Inc., Grand Junction, Colo.

[21] Appl. No.: 176,679

[22] Filed: Aug. 11, 1980

[51] Int. Cl.[3] ..... E21B 43/247; E21C 41/10

[52] U.S. Cl. ..... 299/2; 102/312; 166/259; 299/13

[58] Field of Search ..... 166/259, 299, 247; 299/2, 13; 102/22, 23, 311, 312

[56] References Cited

U.S. PATENT DOCUMENTS

| | | | |
|---|---|---|---|
| 3,228,468 | 1/1966 | Nichols | 166/259 |
| 3,951,456 | 4/1976 | Ridley | 299/2 |
| 4,043,597 | 8/1977 | French | 166/299 X |
| 4,149,595 | 4/1979 | Cha | 166/259 |
| 4,167,291 | 9/1979 | Ridley | 299/2 |
| 4,191,251 | 3/1980 | Cha | 166/259 X |
| 4,224,990 | 9/1980 | Cha | 166/259 X |
| 4,246,965 | 1/1981 | Cha | 299/2 X |
| 4,266,612 | 5/1981 | French | 299/2 |

*Primary Examiner*—Stephen J. Novosad
*Assistant Examiner*—George A. Suchfield
*Attorney, Agent, or Firm*—Christie, Parker & Hale

[57] ABSTRACT

A method is provided for flattening a non-planar combustion zone which is advancing through a fragmented permeable mass of formation particles in an in situ oil shale retort. To effect flattening of the non-planar combustion zone, a fragmented permeable mass of formation particles having generally horizontally extending layers of various void fraction is provided in the in situ retort. At least one layer has a substantially higher effective average void fraction than adjacent layers above and below this layer. When the advancing non-planar combustion zone enters the high void fraction layer, it spreads laterally across the layer. The resulting combustion zone is approximately flat in a plane transverse to its direction of advance when it exits the high void fraction layer.

21 Claims, 4 Drawing Figures

IN SITU OIL SHALE RETORT WITH NON-UNIFORMLY DISTRIBUTED VOID FRACTION

FIELD OF THE INVENTION

This invention relates to processing of oil shale and, more particularly, to a method for flattening a combustion zone advancing through an in situ oil shale retort.

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is, in fact, a misnomer; it is neither shale nor does it contain oil. It is a sedimentary formation comprising a marlstone deposit with layers containing an organic polymer called "kerogen" which, upon heating, decomposes to produce liquid and gaseous products, including hydrocarbon products. It is the formation containing kerogen that is called "oil shale" herein and the liquid hydrocarbon product is called "shale oil".

A number of methods have been proposed for processing oil shale which involve either mining the kerogen-bearing shale and processing the shale on the surface, or processing the shale in situ. The latter approach is preferable from the standpoint of environmental impact since the spent shale remains in place, reducing the chance of surface contamination and the requirement for disposal of solid wastes. According to both of these approaches, oil shale is retorted by heating the oil shale to a sufficient temperature to decompose kerogen and produce shale oil which drains from the rock. The retorted shale, after kerogen decomposition, contains substantial amounts of residual carbonaceous material which can be burned to supply heat for retorting.

The recovery of liquid and gaseous products from oil shale deposits has been described in several patents, such as U.S. Pat. Nos. 3,661,423; 4,043,595; 4,043,596; 4,118,071; 4.043,597; and 4,043,598 which are incorporated herein by this reference. These patents describe in situ recovery of liquid and gaseous hydrocarbon materials from a subterranean formation containing oil shale, wherein such formation is explosively expanded to form a stationary, fragmented permeable body or mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbon products, and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate composition, and any gaseous retort inlet mixture that does not take part in the combustion process. The products of retorting are referred to herein as liquid and gaseous products.

U.S. Pat. No. 4,943,595, which is assigned to the same assignee as this application, discloses a method for explosively expanding formation containing oil shale to form an in situ oil shale retort. According to a method disclosed in that patent, an in situ retort is formed by excavating formation to form a columnar void bounded by unfragmented formation having a vertically extending free face, drilling blasting holes adjacent the columnar void and parallel to the free face, loading the blastholes with explosive, and detonating the explosive. This expands the formation adjacent the columnar void toward the free face in layers severed in a sequence progressing away from the free face so that fragmented formation particles occupy the columnar void and the space in the in situ retort site originally occupied by shale prior to such explosive expansion. The void fraction or void volume in the fragmented mass corresponds to the volume of the columnar void formed before explosive expansion. The void fraction in the resulting fragmented permeable mass is determined by the volume of formation removed from the retort site to form a void space toward which unfragmented formation remaining in the retort site is explosively expanded, inasmuch as such unfragmented formation is fragmented and expanded to fill such a void space. The original void volume is essentially distributed between the fragmented formation particles and the retort being formed.

U.S. Pat. No. 4,043,598 discloses a method for explosively expanding formation containing oil shale toward horizontal free faces to form a fragmented mass in an in situ oil shale retort. According to a method disclosed in that patent, a plurality of vertically spaced apart voids of similar horizontal cross-section are initially excavated one above another within the retort site. A plurality of vertically spaced apart zones of unfragmented formation are temporarily left between the voids. Explosive is placed in each of the unfragmented zones and detonated, preferably in a single round, to explosively expand each unfragmented zone into the voids to form a fragmented mass. Retorting of the fragmented mass is then carried out to recover shale oil from the oil shale.

U.S. Pat. No. 4,192,554 issued to me on Mar. 11, 1980, describes a method for forming an in situ oil shale retort by expanding formation toward vertically spaced apart voids. U.S. Pat. No. 4,192,554 is incorporated herein by this reference.

It has been found that when forming in situ oil shale retorts, the fragmented permeable mass of formation particles can have a maldistribution of void fraction. For example, a fragmented permeable mass of formation particles can have vertically extending regions having a higher void fraction than regions which are adjacent laterally to such vertically extending regions. This maldistribution of void fraction can lead to higher gas flow in the region of higher void fraction than in the other regions.

When this occurs, a combustion zone formed in an upper portion of the fragmented permeable mass can advance more rapidly through the vertical region having a higher void fraction than through adjacent regions of lower void fraction. This can result in warping or skewing of the combustion zone as it advances through the retort.

It has been found that the yield of liquid and gaseous products from oil shale tends to be maximized when the combustion zone extends across the entire fragmented permeable mass and moves through the retort as a substantially planar wave. When the combustion zone is not planar, the yield of liquid and gaseous hydrocarbon products from the oil shale tends to be reduced. This reduction occurs firstly because the oil shale in some portions of the retort can be bypassed by the non-planar combustion and retorting zones and secondly because some of the shale oil produced by one portion of the combustion zone can be consumed by oxidation in another portion.

In upper regions of the fragmented mass, the locus of a combustion zone can be controlled by varying inlet gas composition and/or flow rate to various portions of the fragmented mass. Thus, for example, a secondary combustion zone can be sustained in a portion of the fragmented mass for controlling the rate of advancement of a primary combustion zone in adjacent regions of the fragmented mass. A secondary combustion zone is sustained by including a fuel in the retort inlet mixture. As used herein, the term "primary combustion zone" refers to a portion of the retort where the greater part of the oxygen in a retort inlet mixture that reacts with residual carbonaceous material in the retorted oil shale is consumed. As used herein, the term "secondary combustion zone" refers to that portion of the retort where fuel in the retort inlet mixture is consumed.

Control of the locus of the primary combustion zone by use of a secondary combustion zone is believed to be ineffective at distances greater than about 40 to about 60 feet below the top of the fragmented mass.

It is, therefore, desirable to provide a method for flattening a primary combustion zone advancing through an in situ retort when the combustion zone is a substantial distance below the top of the fragmented mass.

SUMMARY OF THE INVENTION

This invention relates to a method for flattening a combustion zone in a fragmented permeable mass of formation particles. The formation particles contain oil shale and are in an in situ oil shale retort in a subterranean formation containing oil shale.

Unfragmented formation is explosively expanded for forming a fragmented permeable mass of formation particles comprising a first generally horizontally extending layer of formation particles extending substantially across the entire horizontal extent of the retort. The first layer has an effective average void fraction substantially greater than the effective average void fraction of second generally horizontally extending adjacent layers of formation particles above and below such a first layer. A combustion zone is established in an upper region of the fragmented permeable mass above the first layer. The combustion zone is advanced downwardly through the fragmented mass and is spread laterally across the first layer for forming an approximately flat combustion zone across substantially the entire horizontal extent of the retort.

DRAWINGS

These and other features, aspects, and advantages of the present invention will be more fully understood by referring to the following detailed description, appended claims, and the accompanying drawings in which:

DETAILED DESCRIPTION

Figure 1:
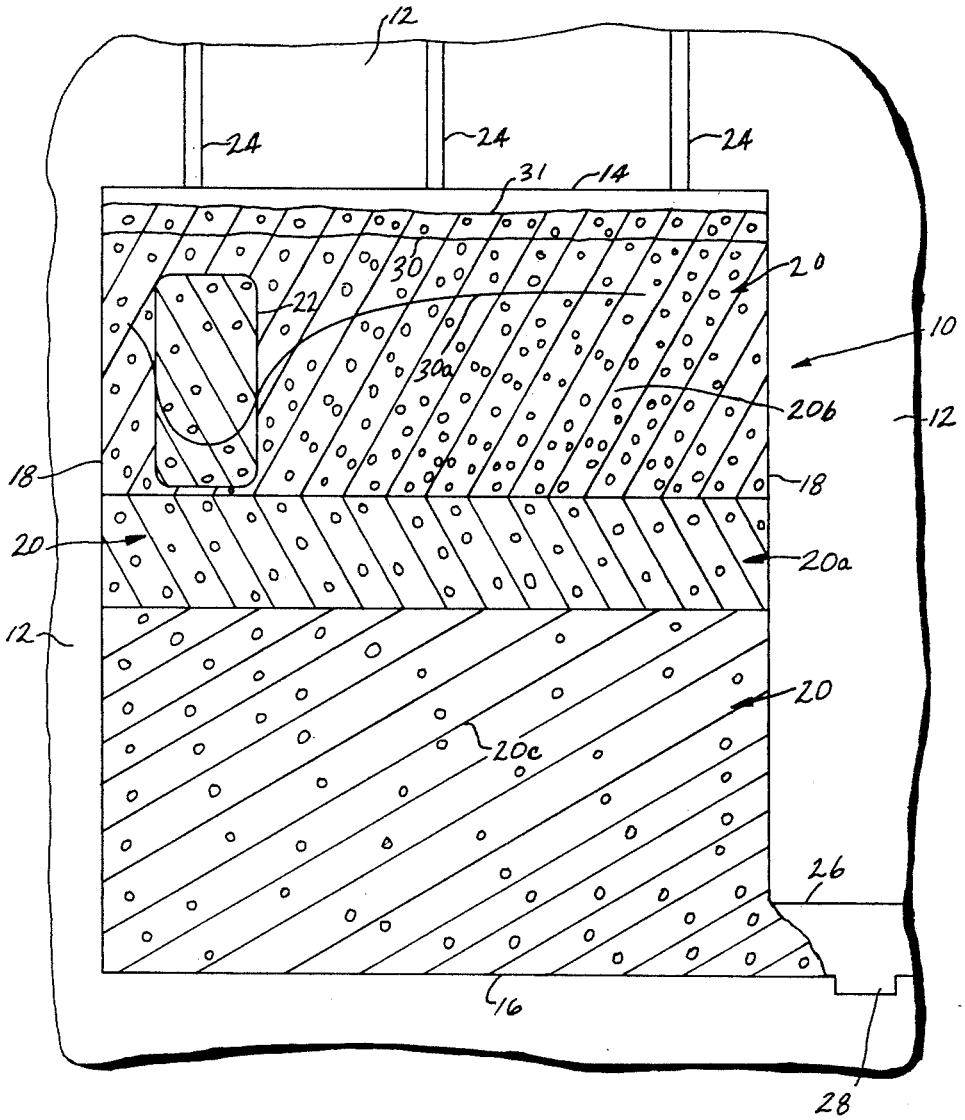
FIG. 1 is a semi-schematic vertical cross-sectional view of an in situ oil shale retort formed in accordance with practice of principles of this invention.

FIG. 1 is a semi-schematic vertical cross-sectional view of an in situ oil shale retort 10 formed in a subterranean formation 12 containing oil shale. In an exemplary embodiment, the in situ oil shale retort can be square or rectangular in horizontal cross-section, however, retorts having other shapes can also be formed if desired.

The retort 10 has generally horizontally extending top and bottom boundaries 14 and 16 and generally vertically extending side boundaries 18 of unfragmented formation.

Within the boundaries of the retort, a fragmented permeable mass of formation particles 20 containing oil shale is provided. In the exemplary embodiment, the fragmented permeable mass has an unevenly distributed void fraction, i.e., various portions or layers of the fragmented mass have a different average void fraction. For example, the fragmented permeable mass comprises an upper portion **20*b* having a first effective average void fraction, a lower portion 20*c* having a second effective average void fraction, and a generally horizontally extending intermediate layer 20*a* between the upper and lower portions. The layer 20*a* extends substantially across the entire horizontal extent of the retort and has an effective average void fraction which is substantially greater than the effective average void fraction of the horizontally extending layers or portions 20*b* and 20*c* which are directly above and below the layer 20*a***.

As used herein, effective void fraction means the void fraction of formation particles at the elevated temperatures in the retorting and combustion zones. The volume of the oil shale increases when the temperature increases and consequently the void decreases. It is found that rich oil shale having high kerogen content expands to a greater extent than lean oil shale having low kerogen content. Thus, to have the same effective void fraction at temperatures in the combustion and retorting zone, rich oil shale should have a higher void fraction at ambient temperature than the void fraction of lean oil shale at ambient temperature.

U.S. Pat. Nos. 4,167,291 and 4,149,595, for example, describe an in situ oil shale retort in which fragmented formation particles from a stratum having a higher kerogen content have a higher void fraction than the average void fraction of the entire fragmented mass. This avoids a low void fraction in the layer of formation particles with a higher kerogen content when the particles are heated by the high temperature combustion and retorting zones. U.S. Pat. Nos. 4,167,291 and 4,149,595 are incorporated herein by this reference.

Preferably, the effective average void fraction of the high void fraction layer 20*a* is from about 2% to about 10% in absolute percentage points greater than the effective average void fraction of the layer of formation particles 20*b* above the high void fraction layer 20*a* and the layer of formation particles 20*c* below the high void fraction layer 20*a*.

For example, when the effective average void fraction of layers 20*b* and 20*c* is about 20%, then preferably the effective average void fraction in the high fraction layer 20*a* is from about 22% to about 30%.

It is believed that the effective average void fraction of the high void fraction layer should be at least about 2% higher than the effective average void fraction of adjacent layers to enhance spreading of a combustion zone laterally across this layer, thereby forming a flattened combustion zone. On the other hand, when such a high void fraction layer has an effective average void fraction greater than about 10% higher than adjacent layers, less oil shale is available to be retorted, resulting in reduced yield from retorting. Also, if the average effective void fraction of the high void fraction layer is too high relative to adjacent layers, the combustion zone can advance too rapidly laterally in the high void fraction layer, undercutting large areas of less advanced portions of the combustion zone. This can further reduce the yield of shale oil from the retorting process.

One or more conduits 24 extend through unfragmented formation to the top of the fragmented permeable mass of formation particles. The conduits 24 can be used for igniting the fragmented permeable mass of formation particles and for introduction of a retort inlet mixture such as air or other oxygen-supplying gas to support combustion.

As described below in greater detail, a combustion zone formed substantially horizontally across the fragmented permeable mass of formation particles can become skewed or warped as it advances downwardly through the retort due to a maldistribution of void fraction in the fragmented mass.

For example, the fragmented permeable mass 20 has a maldistribution of void fraction which, for illustrative purposes, is shown as a generally vertically extending region 22. The region 22 has a void fraction greater than the void fraction in laterally adjacent regions. In this example, the region 22 extends downwardly from below the upper surface 31 of the fragmented permeable mass to the region of the fragmented mass above the high void fraction layer 20*a*.

The high void fraction layer 20*a* is, therefore, provided for effecting a self-correcting, i.e., a flattening of the primary combustion zone, as the combustion zone advances through the region 20*a*.

A tunnel or drift 26 is provided at the bottom of the retort as a retort outlet for withdrawal of liquids and off gas. Off gas includes the products of combustion of carbonaceous material in the oil shale, any gaseous non-reactive portion of the retort inlet mixture, and gaseous products of retorting. A sump 28 is provided as a retort outlet for collecting liquid products including shale oil and water. If desired, the bottom of the retort can be closed, i.e., the drift 26 blocked by a bulkhead, and products removed through conduits in the tunnel.

In an exemplary embodiment, a processing zone is established in an upper portion of the fragmented mass in the in situ retort near the bottom of one or more of the inlet conduits 24. As used herein, the term "processing zone" refers to a hot portion of the fragmented permeable mass such as a primary combustion zone and/or a retorting zone. A processing zone can be established by any known method such as methods described in either U.S. Pat. No. 3,661,423 or U.S. patent application Ser. No. 929,447, filed July 31, 1978, now U.S. Pat. No. 4,263,970, by Chang Yul Cha, and assigned to the assignee of this application. U.S. Pat. No. 3,661,423 and application Ser. No. 929,447 are incorporated herein by this reference.

To establish a processing zone, i.e., combustion and retorting zones, formation particles near the upper surface 31 of the fragmented permeable mass are ignited. Ignition can be effected by lowering a burner into one or a plurality of the inlet conduits 24 and directing hot ignition gases from the burner downwardly toward the surface of the formation particles. Heating is continued until a portion of the formation particles is at a temperature greaer than the self-ignition temperature of carbonaceous material in oil shale which, in an exemplary embodiment, can be considered to be about 900° F.

After ignition, the burner(s) can be withdrawn from the conduits 24 and an oxygen-supplying gas such as air or air diluted with recycled off gas or steam or the like can be introduced through one or more of the conduits. Continued introduction of the oxygen-supplying gas into the fragmented mass on the trailing side of the combustion zone causes the combustion zone to advance through the retort. Heat conveyed by flowing gases establishes a retorting zone on the advancing side of the combustion zone. The retorting zone is advanced through the fragmented mass on the advancing side of the combustion zone, whereby kerogen is decomposed in the retorting zone for providing liquid and gaseous products. The liquid and gaseous products are withdrawn from the retort through the withdrawal drift 26.

Before the primary combustion zone is advanced a substantial distance downwardly through the retort, it is desirable to spread such a combustion zone uniformly across the entire horizontal extent of the retort. One method of spreading the primary combustion zone laterally is by forming a secondary combustion zone upstream from the primary combustion zone. A secondary combustion zone can be formed by introducing a combustible mixture of fuel and air or other oxygen-supplying gas through one or more of the conduits into the fragmented permeable mass. The ratio of fuel-to-air can be calculated and maintained so that the fuel ignites below the surface of the fragmented mass and upstream from the primary combustion zone.

U.S. Pat. No. 4,191,251 provides additional details relating to establishment and maintenance of a secondary combustion zone in an in situ oil shale retort. U.S.

Pat. No. 4,191,251 is incorporated herein by this reference.

As the secondary combustion zone spreads laterally across the fragmented mass of formation particles in the retort, particles are heated to their self-ignition temperature, thereby spreading the primary combustion zone laterally across the retort. By using this technique, a substantially flat primary combustion zone is formed across the entire horizontal extent of the retort.

For example, the substantially flat primary combustion zone 30 extends across the entire horizontal extent of the retort. Once the primary combustion zone has been spread to the extent desired, the secondary combustion zone can be extinguished while introduction of oxygen-supplying gas is continued for advancing the primary combustion zone and retorting zone, i.e., the processing zone, downwardly through the retort.

The primary combustion zone can travel downwardly through the fragmented mass in a planar wave through regions of the retort which have a uniform void fraction. This is because gas flows substantially uniformly through such regions, resulting in even heating of oil shale particles in a horizontal plane transverse to the direction of the advance of the combustion zone in these regions.

However, when a maldistribution of void fraction exists in the fragmented mass as described above due to the region 22, the combustion zone can be warped or skewed as it advances through such a region. For instance, the vertically extending region 22 can act as a gas channel, resulting in a greater portion of the oxygen-supplying gas introduced into the retort preferentially flowing through this region and bypassing adjacent areas of lower effective void fraction. Therefore, heat of comubstion is carried through the region 22 more rapidly than through adjacent regions, resulting in the combustion zone advancing more rapidly through this region than through such adjacent regions. To illustrate this uneven advancement, the primary combustion zone 30 is designated **30*a* after it has advanced downwardly through a portion of the retort. The portion of the combustion zone which has passed through the region 22 has advanced more rapidly than portions which extend laterally through adjacent regions. The combustion zone 30*a* is no longer flat, but is skewed or warped from its original planar shape. The retorting zone on the advancing side of the combustion zone 30*a*** can tend to have the same shape as the combustion zone.

Having a non-planar combustion zone, such as the combustion zone **30*a*, can result in products produced in less advanced portions of the retorting zone flowing into more advanced portions of the combustion zone and being consumed therein. Additionally, the primary combustion zone 30*a*** can become increasingly more skewed as it continues to advance through the retort.

When the primary combustion zone is skewed, a more advanced portion of the primary combustion zone reaches the bottom of the retort before less advanced portions. Once any portion of the primary combustion zone reaches the bottom of the retort, off gases exiting the retort can be heated to temperatures high enough to cause damage to product withdrawal equipment. Therefore, when such a portion of the combustion zone reaches the bottom region of the fragmented mass, retorting is stopped. This can result in a substantial portion of oil shale below less advanced portions of the combustion zone not being retorted, causing a loss of yield and undesirable increase in the cost of retorting operations.

Although a secondary combustion zone has been found to be effective in flattening a primary combustion zone in upper regions of a fragmented permeable mass, it has been found that use of a secondary combustion zone is not effective at lower elevations in a retort. For instance, use of a secondary combustion zone is not effective for flattening a primary combustion zone which has advanced more than about 40 to about 60 feet or so below the upper surface of the fragmented mass.

Therefore, to provide for flattening a combustion zone at distances more than about 40 feet or so below the surface of the fragmented mass, at least one horizontally extending layer of formation particles **20*a* having a higher effective average void fraction than adjacent layers is formed a substantial distance below the surface. That is, the layer 20*a* can be formed more than about 40 feet below the upper surface 31** of the fragmented permeable mass of formation particles.

However, if desired, the layer **20*a* can be formed nearer the surface than 40 feet to provide for self-correction or flattening of the primary combustion zone in upper regions of the fragmented mass as well. For example, if desired, the high void fraction layer can be formed at about the surface of the fragmented permeable mass of formation particles. Also, more than one high void fraction layer, such as the layer 20*a***, can be used if desired. These high void fraction layers can be formed at elevations in the retort as desired to most effectively flatten the primary combustion zone advancing through the retort.

Additionally, one or more high void fraction layers of formation particles, such as the layer **20*a***, can be formed in a retort when there is no maldistribution of void fraction, if desired. For example, if the combustion zone has not spread entirely across the retort due to ignition problems or the like, its spread laterally will be enhanced by the high void fraction layer provided.

The high void fraction layer **20*a*** acts as a gas plenum or manifold for uniformly spreading the gas flow across the horizontal extent of the retort in this layer. In addition to enhancing lateral spread and flattening of a combustion zone, this results in gas flow below the layer being uniform across the horizontal cross-section of the retort. Having a uniform gas flow below the high void fraction layer aids in maintaining the combustion zone flat as it advances downwardly through the fragmented mass below such a layer.

In the exemplary embodiment, gas flow is higher in the vertical region 22, which is shown near the edge of the fragmented permeable mass, than in adjacent regions above the horizontal extending layer **20*a*. Therefore, the portions of the combustion zone 30*a* passing through the region 22 advance more rapidly than other portions of the combustion zone. When the most advanced portion of the combustion zone 30*a* reaches the high void fraction layer 20*a***, it tends to spread laterally through the high void fraction layer, forming a flattened combustion zone.

In practice of principles of this invention, the effective average void fraction differential between such layer of higher average void fraction and adjacent layers of lower average void fraction above and below the high void fraction layer can be varied as desired. Additionally, layers of relatively higher void fraction can have various thicknesses as desired.

For example, it is desirable that the combination of thickness and effective average void fraction of the high void fraction layer 20*a* be such that a combustion zone will spread laterally across the layer at a rate sufficient so that when the combustion zone exits the bottom of the layer, it extends across the entire retort approximately in a plane transverse to the direction of its advance. It is also desirable that the effective average void fraction differential between the layer 20*a* and the layers 20*b* and 20*c* is not so great as to cause an undesirably rapid lateral spread of the combustion zone across the layer 20*a*. If the rate of lateral spread is too fast, the combustion zone advancing laterally can undercut large areas of the less advanced portions of the combustion zone advancing toward layer 20*a*. If this occurs, shale oil being produced above the high void fraction layer can be consumed by the combustion zone advancing laterally through such a layer.

As described above, it is believed that having an effective average void fraction in the layer 20*a* between about 2% and about 10% greater than the effective average void fraction in the layers 20*b* and 20*c* is desired. Additionally, the thickness of the layer 20*a* can be from less than about 10 feet to 40 or 50 feet or so, as desired, depending on the void fraction differential.

If the high void fraction layer is too thin, for example, the combustion zone can pass through such a thin layer too rapidly for flattening of the combustion zone to occur. If the high void fraction layer is thicker than required for flattening the combustion zone, there is an unnecessary reduction in the amount of oil shale retorted which can result in reduced shale oil yields.

A high void fraction layer such as the layer 20*a* can be provided across an in situ retort when blasting toward horizontal free faces. This can be achieved by expanding a portion of unfragmented formation adjacent a void to a higher void fraction than the balance of the formation expanded toward such a void. Alternatively, when more than one void is used, a portion of the formation expanded toward one of the voids is expanded to a greater extent than formation expanded toward the other voids.

Additionally, high void fraction layers can be provided by blasting toward vertical free faces.

Details of forming an in situ oil shale retort having a fragmented mass with layers of varying void fraction can be found in U.S. Pat. Nos. 4,167,291 and 4,149,595 which are incorporated hereinabove. These patents disclose forming a fragmented mass using either a vertical or horizontal free face system. Additionally, it is disclosed that formation particles from a stratum of higher kerogen content initially form a layer which has a larger average void fraction than the average void fraction of the fragmented mass. When the oil shale is heated by a combustion zone and/or a retorting zone, the layer of higher kerogen content expands more than the other portions of the fragmented mass, resulting in a fragmented permeable mass having a more uniform void fraction at these higher temperatures. In other words, the effective average void fraction of the layer of higher kerogen content is about equal to the effective average void fraction of the fragmented mass.

Figure 2:
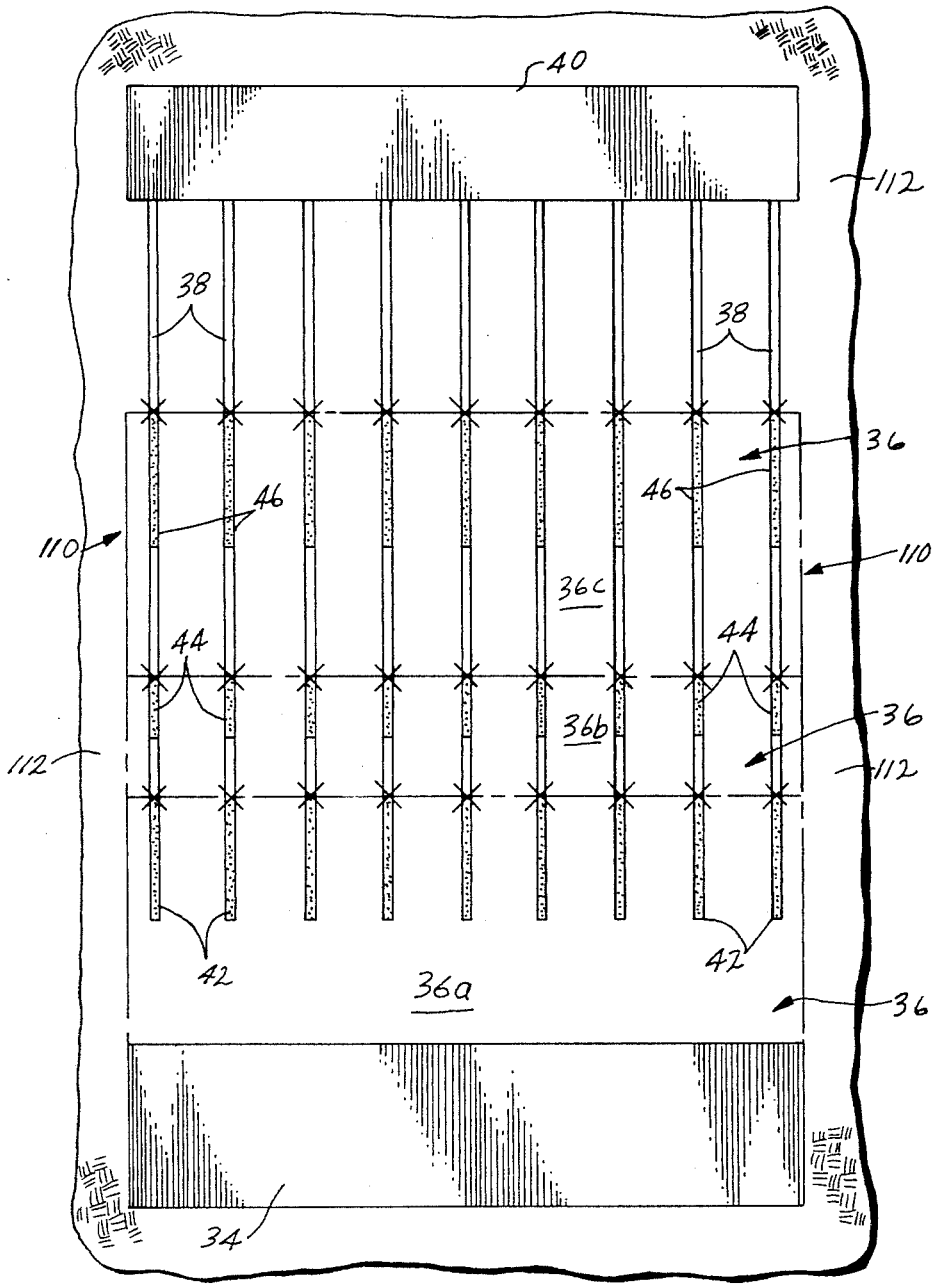
FIG. 2 is a semi-schematic vertical cross-sectional view of an in situ oil shale retort at one stage of preparation in accordance with practice of principles of this invention.
Figure 3:
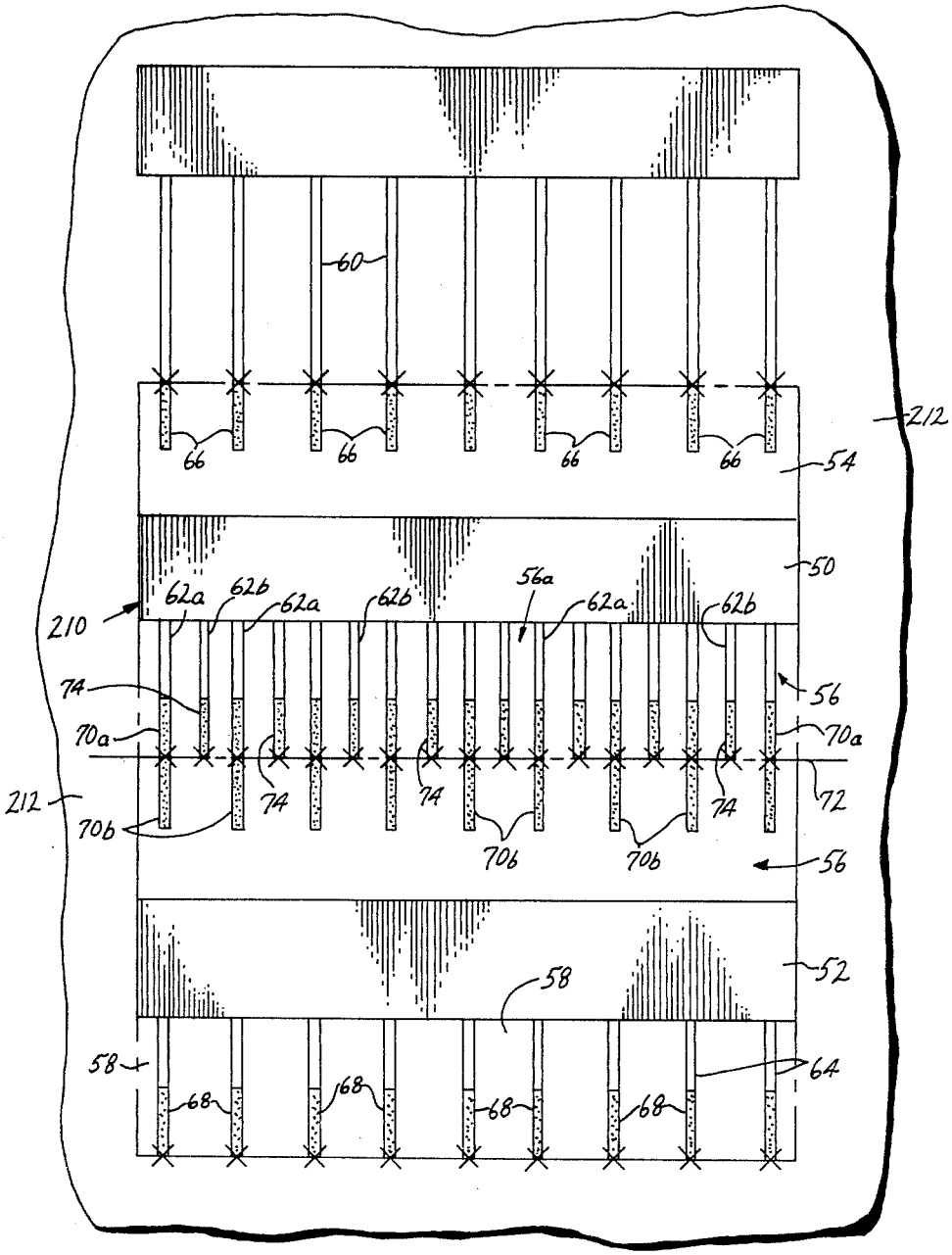
FIG. 3 is a semi-schematic vertical cross-sectional view of an in situ oil shale retort at one stage in preparation in accordance with practice of principles of this invention.
Figure 4:
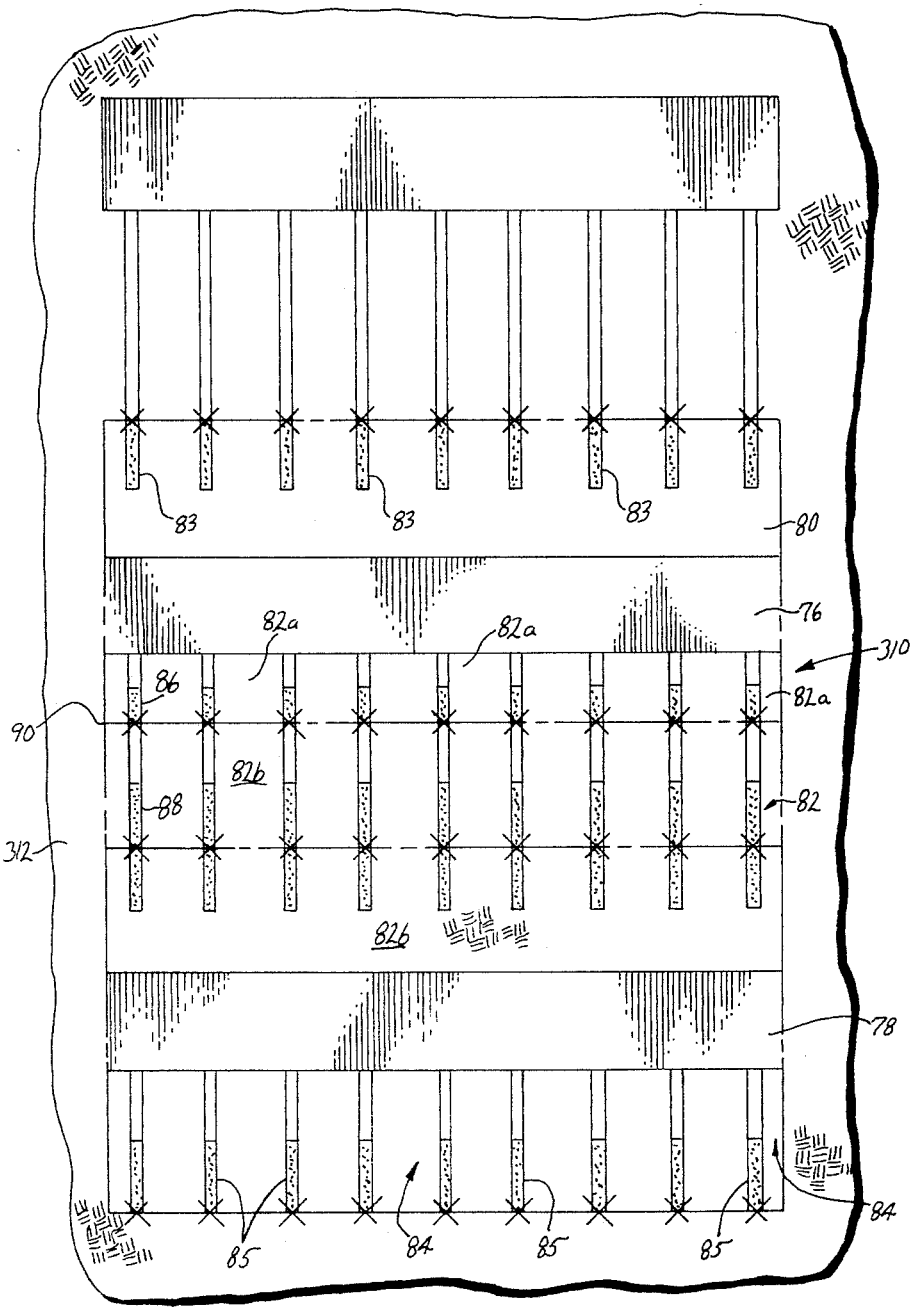
FIG. 4 is a semi-schematic vertical cross-sectional view of an in situ oil shale retort at one stage in preparation in accordance with practice of principles of this invention.

Exemplary embodiments of methods used for forming a fragmented permeable mass of formation particles comprising a horizontally extending layer of relatively higher void fraction bounded by layers of relatively lower void fraction can be more fully understood by referring to FIGS. 2, 3, and 4.

FIG. 2 is a semi-schematic vertical cross-sectional view of an in situ oil shale retort 110 at one stage of preparation in a subterranean formation 112 using a single horizontally extending void system.

A generally horizontal void 34 is mined into the formation, leaving a zone of unfragmented formation 36 above the void. An array of horizontally spaced apart vertical blastholes 38 is drilled into the unfragmented formation from an open base of operation 40 above the void 34. The blastholes are exaggerated in width and spacing in the drawings for clarity. Although only one row of blastholes is shown, additional rows are drilled for providing substantially equal distribution of explosive across the horizontal extent of the unfragmented formation. Alternatively, when no open base of operation is provided, blastholes can be drilled from the ground surface or from a series of tunnels above the retort.

Details of forming arrays of vertical blastholes in unfragmented formation can be found in U.S. Pat. No. 4,192,554, incorporated hereinabove by reference.

Explosive is loaded into the blastholes for forming arrays of substantially vertical columnar explosive charges in the zone of unfragmented formation. A first array of explosive charges 42 is formed for expanding a generally horizontally extending lower portion 36*a* of the unfragmented formation toward the void 34. A second array of explosive charges 44, which is vertically spaced apart from the first array, is formed for expanding a generally horizontally extending intermediate portion 36*b* of the unfragmented formation toward the void 34. A third array of explosive charges 46, which is vertically spaced apart from the second array, is formed for expanding a generally horizontally extending upper portion 36*c* of the unfragmented formation toward the void 34.

Detonators designated by an "x" are placed in each explosive charge and the portion of the blastholes between the arrays of charges is stemmed with inert material such as sand or gravel or the like.

The thickness of the lower, intermediate, and upper portions of the zone of unfragmented formation relative to each other as shown in FIG. 2 is for illustrative purposes. The thickness of each portion relative to the thickness of the other portions can be varied as desired in practice of this invention.

In an exemplary embodiment, the layer of formation particles having a substantially higher void fraction than the adjacent layers of formation particles above and below is formed by varying the void volume available relative to the amount of formation expanded for expansion of each of the portions of unfragmented formation. In this embodiment, the powder factor of each array of explosive charges is about the same. The term "powder factor" as used herein is the amount of explosive energy used per unit volume of formation expanded.

The first portion 36*a* of unfragmented formation adjacent the underlying void 34 is explosively expanded toward the void by detonation of the explosive charges 42. The volume of the void 34 divided by the volume of the first portion 36*a* plus the volume of the void 34 defines a first available void ratio. Formation particles from the portion 36*a* form a first horizontally extending layer of the fragmented mass having a first average void fraction which is a direct function of the available void ratio.

After the first explosive expansion, a first void space is left between the top of the first layer of formation particles and the bottom of the second portion, i.e., the intermediate portion 36b of the zone of unfragmented formation. The second portion 36b of unfragmented formation is explosively expanded toward the first void space by detonation of the explosive charges 44. The volume of the first void space divided by the volume of the second portion plus the volume of the first void space defines a second available void ratio. The second available void ratio is designed to be greater than the first available void ratio. This results in a second horizontally extending layer of the fragmented permeable mass of formation particles having a second average void fraction which is higher than the first average void fraction.

After the second explosive expansion, a second void space is left between the top of the second layer of formation particles and the bottom of the third portion, i.e., the upper portion 36c of the zone of unfragmented formation. The third portion of the zone of unfragmented formation is then explosively expanded toward the second void space by detonation of the explosive changes 46. The volume of the second void space divided by the volume of the third portion plus the volume of the second void space defines a third available void ratio. The third available void ratio is designed to be less than the second available void ratio. Formation particles from the upper portion 36c of the zone of unfragmented formation form a third horizontally extending layer of the fragmented permeable mass of formation particles having a third average void fraction. The third average void fraction is less than the second average void fraction.

If desired, the arrays of explosive charges can be detonated in a single round with time delays between detonations or can be detonated in a plurality of separate rounds. The time delays can be between expansion of each portion of the zone of unfragmented formation and also, if desired, between charges in each portion.

When a single round is used, time delays between the expansion of each portion of the zone of unfragmented formation are short enough so that there is dynamic interaction between formation particles from the different portions of the zone of unfragmented formaton. If desired, for example, when using a single round, the time delay between explosive expansion of the third portion 36c and explosive expansion of the second portion 36b can be shorter than the time delay between explosive expansion of the first portion 36a and the second portion 36b. This results in additional expansion of the second portion providing an even greater void fraction in the second layer of the fragmented permeable mass of formation particles.

Also, if time delays between detonations of the explosive charges in the second portion 36b are increased, the void fraction of a layer of formation particles formed from the second layer is increased.

In order to provide void ratios of different magnitude, the thickness of the zones being expanded can be varied and/or when using separate rounds, the available void space into which the formation is expanded can be varied.

One technique for varying the available void space is to form a void in the formation and remove formation particles from the void in stages as layers of unfragmented formation are expanded toward the void. Horizontally extending layers of high void fraction can be provided with such a retort-forming technique by permitting some zones of unfragmented formation to expand to a greater extent than other zones. That is, some zones can be expanded toward a void of smaller volume so that the void fraction is limited, while other zones can be expanded toward larger voids so that a higher void fraction results.

In another exemplary embodiment, the powder factor of the second array 44 of explosive charges is higher than the powder factor of either the first array 42 or the third array 46. In this embodiment, the intermediate portion 36b of the zone of unfragmented formation can have a thickness about equal to or even greater than the thickness of the upper and lower zones of unfragmented formation. The added expansion of the intermediate portion and resulting high void fraction of the layer of formation particles formed from the intermediate portion is due to the increased powder factor of the array of charges in the intermediate portion.

In this embodiment, the first array of explosive charges 42 is detonated for expanding the lower portion 36a of the unfragmented formation toward the void 34. Explosive expansion of the portion 36a provides a first or lower horizontally extending layer of the fragmented permeable mass of formation particles in the in situ oil shale retort, while leaving a first void space between the layer of formation particles and the intermediate portion 36b of unfragmented formation. After a time delay, the second array of explosive charges 44 is detonated for expanding the intermediate portion 36b of unfragmented formation toward the first void space. Explosive expansion of the portion 36b provides a second or intermediate horizontally extending layer above the first layer and leaves a second void space between the second layer and the upper portion 36c of unfragmented formation. Then, after another time delay, the third array of explosive charges 46 is detonated for expanding the upper portion 36c of unfragmented formation toward the second void space. Explosive expansion of the upper portion 36c provides a third or upper layer of the fragmented permeable mass of formation particles above the second layer.

Because the second array of explosive charges has a higher powder factor than either the first or third arrays, the portion 36b of unfragmented formation is expanded to a greater extent than the upper and lower portions 36a or 36c of unfragmented formation. This results in the second or intermediate layer of the fragmented permeable mass of formation particles having a higher void fraction than either the first or third layers.

If desired, the techniques described above which include using arrays of explosive charges with different powder factors and using variable available void ratios can be combined with each other in practice of principles of this invention.

Also, when using these techniques either alone or in combination with each other, time delays between explosive expansion of portions of a zone of unfragmented formation in a single round can be varied as desired to alter the void fraction of the layers of formation particles formed. For example, by extending the time delay between explosive expansion of a first and a second portion of unfragmented formation, the formation expanded from such a second portion has more room in which to expand and hence can expand to a greater degree than when the original shorter time delay was used. Therefore, the void fraction of the layer of formation particles formed when using the longer delay is higher than the void fraction of the layer formed when the shorter time delay was used.

Also, time delays can be used between explosive charges in each portion of a zone of unfragmented formation if desired. When the time delays between detonation in a portion is increased, the void fraction of the layer of formation particles formed from this portion is increased.

In other embodiments of this invention, a fragmented permeable mass of formation particles having a generally horizontally extending layer of higher effective average void fraction relative to the effective average void fraction in adjacent layers above and below can be formed by expanding unfragmented formation toward a plurality of voids.

An exemplary embodiment of practice of principles of this invention, using a multiple void system, can be understood by referring to FIG. 3. FIG. 3 is a semi-schematic vertical cross-sectional view of an in situ retort 210 at one stage of preparation.

An upper or first generally horizontally extending void 50 and a lower or second generally horizontally extending void 52 are excavated into the subterranean formation 212. An upper zone of unfragmented formation 54 is above the upper void, an intermediate zone of unfragmented formation 56 is between the upper and lower voids, and a lower zone of unfragmented formation 58 is below the lower void.

Although two voids are used in this exemplary embodiment, more than two voids can be utilized if desired.

Additional details of explosive expansion of unfragmented formation toward horizontally extending voids can be found in U.S. Pat. No. 4,192,554, incorporated hereinabove by reference.

In the exemplary embodiment, the upper and lower zones of unfragmented formation are loaded with explosive for expanding the upper zone downwardly toward the upper void and for expanding the lower zone upwardly toward the lower void. An upper portion **56*a* of the intermediate zone of unfragmented formation is loaded with explosive for expanding the upper portion upwardly toward the upper void 50. A lower portion 56*b* of the intermediate zone of unfragmented formation is loaded with explosive for expanding the lower portion downwardly toward the lower void 52. For clarity, the upper and lower portions are shown separated by the line 72**.

In order to expand one of the portions of the intermediate zone to a greater extent than the other portion, the powder factor in one of the portions is made higher than the powder factor in the other portion. This results in a layer of relatively higher void fraction, such as the layer **20*a* of FIG. 1**, being formed from the portion of the intermediate layer with the higher powder factor.

In the exemplary embodiment, an array of spaced apart substantially vertical blastholes 60 is formed in the upper zone of unfragmented formation 54, an array of spaced apart substantially vertical blastholes 62 is formed in the intermediate zone of unfragmented formation, and an array of spaced apart substantially vertical blastholes 64 is formed in the lower zone of unfragmented formation.

The array of blastholes 62 in the intermediate zone of unfragmented formation comprises a plurality of longer blastholes designated **62*a* and shorter blastholes designated 62*b***.

To effect the explosive expansion, the blastholes are loaded with explosive for providing an array of substantially columnar vertical explosive charges 66 in the upper zone and an array of substantially vertical columnar explosive charges 68 in the lower zone.

Because the intermediate zone is explosively expanded both upwardly and downwardly, practice of this invention can be better understood if explosive loaded into the blastholes designated **62*a* in the intermediate zone is considered as forming two explosive charges. For instance, explosive 70 loaded into the blastholes 62*a* in the intermediate zone forms a charge above the line 72 and a charge below the line 72. The charge above the line 72 is designated 70*a* and is used for expanding the upper portion 56*a* of the intermediate zone toward the upper void 50. The charge below the line 72 is designated 70*b* and is used for expanding the lower portion of the intermediate zone toward the lower void 52**.

Preferably, the charge **70*a* extends upwardly from the line 72 about one-half the distance to the void 50 and the charge 70*b* extends downwardly from the line 72 about one-half the distance to the void 52**.

Detonators designated by an "x" are placed into the blastholes for initiating detonation of the explosive.

Additionally, the blastholes **62*b* are loaded with explosive, forming a plurality of explosive charges 74**.

In an exemplary embodiment, the volume of the first void is about equal to the volume of the second void and the volume of the upper portion **56*a* of the intermediate zone of unfragmented formation is about equal to the volume of the lower portion 56*b*** of the intermediate zone of unfragmented formation.

Because of the additional explosive charges 74 formed in the blastholes **62*b***, the powder factor in the upper portion of the intermediate zone is greater than the powder factor in the lower portion of the intermediate zone and in the upper or lower zones.

Explosive loaded into the zones of unfragmented formation can be detonated in a single round.

Explosive in the upper zone is detonated for expanding the upper zone downwardly toward the upper void, explosive in the intermediate zone is detonated for expanding the upper portion of the intermediate zone upwardly toward the upper void, and for expanding a lower portion of the intermediate zone downwardly toward the lower void. Additionally, explosive in the lower zone of unfragmented formation is detonated for expanding the lower zone upwardly toward the lower void.

The unfragmented formation expanded forms horizontal layers of formation particles which comprise the fragmented permeable mass of formation particles in the retort.

A first layer of formation particles is formed from the upper zone of unfragmented formation, a second layer of formation particles is formed from the upper portion of the intermediate zone of unfragmented formation, a third layer of formation particles is formed from the lower portion of the intermediate zone of unfragmented formation, and a fourth layer is formed from the lower zone of unfragmented formation.

The upper portion **56*a* of the intermediate zone of unfragmented formation is explosively expanded to a greater extent than unfragmented formation from the lower portion of the intermediate zone 56*b*** because of the additional explosive in the upper zone. This results in the layer formed from the upper portion of the intermediate zone of unfragmented formation having a higher effective average void fraction than layers of formation particles formed from the upper zone, lower zone, or from the lower portion of the intermediatezone of unfragmented formation.

Alternatively, if desired, the powder factor can be made higher in the lower portion of the intermediate zone than the powder factor in the upper portion, resulting in the layer formed from the lower portion being the high void fraction layer.

Also, if desired, instead of providing additional blastholes such as the blastholes 62*b*, the blastholes 62*a* can be loaded more heavily in one or the other portions of the intermediate zone. This uneven loading of the blastholes can provide one of the portions of the intermediate zone 56 with a higher powder factor than the other portions.

In another embodiment, decked charges can be used in a multiple void system to form the layer of higher effective average void fraction.

A multiple void system using decked charges can be better understood by referring to FIG. 4, which shows a semi-schematic vertical cross-sectional view of an in situ oil shale retort 310 at one stage of preparation.

An upper generally horizontally extending void 76 and a lower generally horizontally extending void 78 are excavated into a subterranean formation 312.

An upper zone of unfragmented formation 80 is above the upper void, an intermediate zone of unfragmented formation 83 is between the upper and lower voids, and a lower zone of unfragmented formation 85 is below the lower void.

A plurality of vertical blastholes are formed into each of the zones of unfragmented formation.

An array of substantially vertical columnar explosive charges 83 is formed in the upper zone of unfragmented formation and an array of substantially vertical columnar explosive charges 85 is formed in the lower zone of unfragmented formation. Additionally, a first array 86 and a second array 88 of substantially vertical columnar explosive charges are formed in the intermediate zone of unfragmented formation.

The array of explosive charges 83 in the upper zone is detonated for explosively expanding the upper zone of unfragmented formation downwardly toward the upper void, and the array of explosive charges 85 in the lower zone is detonated for explosively expanding the lower zone of unfragmented formation upwardly toward the lower void. Additionally, the first array 86 of explosive charges in the intermediate zone is detonated for expanding an upper portion 82*a* of the intermediate zone toward the upper void 76. After a time delay of sufficient length to provide for formation of a new horizontally extending free face across the horizontal extent of the intermediate zone, the explosive charges 88 are detonated.

The new free face is in a horizontal plane parallel to the phantom line 90.

Detonation of the charges 88 expands the remaining portion 82*b* of the intermediate zone of unfragmented formation upwardly toward the new free face and downwardly toward the void 78.

Expanding only a small portion of the intermediate zone, i.e., the upper portion 82*a*, before expanding the remaining portion 82*b*, allows formation from the upper portion to expand to a greater extent than formation from the other zones being expanded. This results in the effective average void fraction of the layer of formation particles formed from the upper portion 82*a* being higher than the effective average void fraction of formation particles in adjacent layers.

Alternatively, if desired, in another embodiment, a lower portion of the intermediate zone can be expanded first, resulting in the higher effective average void fraction layer being formed from such a lower portion.

In another exemplary embodiment, the volume of the upper zone of unfragmented formation plus the volume of an upper portion of the intermediate zone of unfragmented formation can be about equal to the volume of the lower zone of unfragmented formation plus a lower portion of the intermediate zone of unfragmented formation, while the volume of the upper void is made different from the volume of the lower void. Explosive expansion of the zones of unfragmented formation in this embodiment results in layers of formation particles wherein one layer has a higher effective average void fraction than other layers due to the difference in the size of the voids.

If desired, the technique of providing voids of different sizes can be used in combination with other multiple void explosive expansion techniques described above.

Additionally, delay times between expansion of the zones of unfragmented formation and also within each zone can be varied as desired when using the multiple void explosion expansion techniques described above. Varying the time delays between detonations can change the void fraction of a layer of formation particles formed from a zone of unfragmented formation. For example, increasing the time delays between detonations within a zone of unfragmented formation can increase the void fraction of the layer of formation particles formed from this zone.

The above description of a method for flattening a combustion zone in a fragmented permeable mass of formation particles, including the description of methods of forming the fragmented mass, is for illustrative purposes. Because of variations which will be apparent to those skilled in the art, the present invention is not intended to be limited to the particular embodiments described above. The scope of the invention is defined in the following claims.

What is claimed is

1. A method for flattening a combustion zone in a fragmented permeable mass of formation particles containing oil shale in an in situ oil shale retort in a subterranean formation containing oil shale, the method comprising the steps of:

(a) explosively expanding unfragmented formation for forming a fragmented permeable mass of formation particles comprising a first generally horizontally extending layer of formation particles extending substantially across the entire horizontal extent of the retort, the first layer having an effective average void fraction greater than the effective average void fraction of second generally horizontally extending adjacent layers of formation particles above and below such a first layer;

(b) establishing a combustion zone in an upper region of the fragmented permeable mass above the first layer;

(c) advancing the combustion zone downwardly through the fragmented permeable mass; and (d) spreading the combustion zone laterally across the first layer for forming an approximately flat combustion zone across substantially the entire horizontal extent of the retort.

2. The method according to claim 1 comprising forming the first generally horizontally extending layer of formation particles at least about forty feet below the top surface of the fragmented permeable mass.

3. The method according to claim 1 comprising forming the first generally horizontally extending layer of formation particles with an effective average void fraction from about 2% to about 10% greater than the effective average void fraction of the second generally horizontally extending layers of formation particles.

4. The method according to claim 1 wherein the first generally horizontally extending layer is from about 10 to about 40 feet thick.

5. A method for recovering liquid and gaseous products from a fragmented permeable mass of formation particles containing oil shale in an in situ oil shale retort in a subterranean formation containing oil shale, the fragmented permeable mass of formation particles comprising at least one generally vertical region having a void fraction greater than the void fraction in regions of the fragmented permeable mass laterally adjacent such a generally vertical region, comprising the steps of:

(a) forming a first generally horizontal layer of formation particles below at least a portion of such a generally vertical region, the first generally horizontal layer extending across substantially the entire horizontal cross-section of the retort and having an effective average void fraction greater than the effective average void fraction of adjacent horizontal layers of formation particles above and below the first layer;

(b) establishing a combustion zone in an upper region of the fragmented permeable mass above the first generally horizontal layer;

(c) introducing oxygen-supplying gas into the fragmented permeable mass on the trailing side of the combustion zone for:

(i) sustaining the combustion zone and advancing the combustion zone through the retort, heat conveyed by flowing gases establishing a retorting zone in the fragmented permeable mass on the advancing side of the combustion zone; and (ii) advancing the retorting zone through the fragmented permeable mass on the advancing side of the combustion zone whereby kerogen is decomposed in the retorting zone for providing liquid and gaseous products, the combustion zone advancing more rapidly through the generally vertical region than through regions of the fragmented permeable mass laterally adjacent such generally vertical region, resulting in the combustion zone having a non-planar shape;

(d) spreading the combustion zone laterally across the first generally horizontal layer for approximately flattening the combustion zone; and (e) withdrawing such liquid and gaseous products from the fragmented mass on the advancing side of the retorting zone.

6. The method according to claim 5 wherein the first generally horizontal layer is at least about forty feet below the upper surface of the fragmented permeable mass.

7. The method according to claim 5 wherein the first generally horizontal layer has an effective average void fraction from about 2% to about 10% greater than the effective average void fraction of such adjacent horizontal layers of formation particles above and below the first layer.

8. An in situ oil shale retort in a subterranean formation containing oil shale, the retort containing a fragmented permeable mass of formation particles containing oil shale, said fragmented permeable mass comprising:

an upper portion having a first effective average void fraction;

a lower portion having a second effective average void fraction; and an intermediate layer between the upper and lower portions having an effective average void fraction sufficiently greater than the effective average void fraction of the upper and lower portions for spreading a combustion zone advancing downwardly through the fragmented mass for forming an approximately flat combustion zone across substantially the entire horizontal extent of the retort.

9. An in situ oil shale retort in a subterranean formation containing oil shale, the retort containing a fragmented permeable mass of formation particles containing oil shale, said fragmented permeable mass comprising:

an upper portion having a first effective average void fraction;

a lower portion having a second effective average void fraction; and an intermediate layer between the upper and lower portions having an effective average void fraction which is from about 2% to about 10% greater than the effective average void fractions of the upper and lower portions for spreading a combustion zone advancing downwardly through the fragmented for forming an approximately flat combustion zone across substantially the entire horizontal extent of the retort.

10. A method for forming a fragmented permeable mass of formation particles containing oil shale in an in situ oil shale retort in a subterranean formation containing oil shale, comprising the steps of:

(a) excavating a generally horizontally extending void in the subterranean formation, leaving a zone of unfragmented formation above the void;

(b) forming at least two arrays of spaced apart substantially vertical columnar explosive charges in the zone of unfragmented formation, a first array nearest the void and a second array more remote from the void, the second array having a powder factor higher than the powder factor of the first array; and (c) detonating the first array of explosive charges for explosively expanding a lower portion of the unfragmented formation toward the void, forming a first horizontally extending layer of a fragmented permeable mass of formation particles in the in situ oil shale retort, while leaving a first void space between the first layer of formation particles and the remaining portion of the zone of unfragmented formation and, after a time delay, detonating the second array of explosive charges for explosively expanding an intermediate portion of the unfragmented formation toward the void, forming a second horizontally extending layer of the fragmented permeable mass of formation particles above such a first layer, the second layer having a higher effective average void fraction than the first layer.

11. The method according to claim 10 wherein the first and second arrays of explosive charges are detonated in a single round.

12. The method according to claim 10 additionally comprising:

(a) forming a third array of explosive charges in the zone of unfragmented formation more remote from the void than the second array, the third array having a powder factor lower than the powder factor of the second array;

(b) leaving a second void space between the second layer of formation particles and the remaining portion of the zone of unfragmented formation; and (c) detonating the third array of explosive charges after detonation of the second array of explosive charges for explosively expanding an upper portion of the zone of unfragmented formation toward the second void space forming a third horizontally extending layer of the fragmented permeable mass of formation particles above the second layer, the third layer having a lower effective average void fraction than the second layer.

13. The method according to claim 12 wherein the arrays of explosive charges are detonated in a single round with time delays between detonation of the arrays, the time delay between detonation of the first and second arrays being longer than the time delay between detonation of the second and third arrays.

14. A method for forming a fragmented permeable mass of formation particles containing oil shale in an in situ oil shale retort in a subterranean formation containing oil shale, comprising the steps of:

(a) excavating a generally horizontally extending void in the subterranean formation, leaving a zone of unfragmented formation above the void;

(b) explosively expanding the zone of unfragmented formation toward the void in a plurality of generally horizontal portions comprising the steps of:

(i) expanding a first portion of the zone of unfragmented formation adjacent the void toward the void, wherein the volume of the void divided by the volume of the first portion plus the volume of the void defines a first available void ratio for forming a first horizontally extending layer of the fragmented mass of formation particles having a first effective average void fraction and leaving a first void space between the top of the first layer of formation particles and the bottom of a second portion of the zone of unfragmented formation; and (ii) expanding the second portion of the zone of unfragmented formation toward the first void space, wherein the volume of the first void space divided by the volume of the second portion plus the volume of the first void space defines a second available void ratio, the second available void ratio being greater than the first available void ratio for forming a second horizontally extending layer of the fragmented mass of formation particles having a second effective average void fraction, the second effective average void fraction being higher than the first effective average void fraction.

15. The method according to claim 14 comprising leaving a second void space between the top of the second layer of formation particles and the bottom of a third portion of the zone of unfragmented formation and expanding the third portion toward the second void space, wherein the volume of the second void space divided by the volume of the third portion plus the volume of the second void space defines a third available void ratio, the third available void ratio being less than the second available void ratio for forming a third horizontally extending layer of the fragmented mass of formation particles having a third effective average void fraction, the third effective average void fraction being less than the second average void fraction.

16. The method according to claim 14 comprising explosively expanding the zone of unfragmented formation toward the void in a single round.

17. The method according to claim 16 wherein a time delay between explosive expansion of the third portion of the zone of unfragmented formation and explosive expansion of the second portion of the zone of unfragmented formation is shorter than a time delay between the explosive expansion of the first portion of the zone of unfragmented formation and explosive expansion of the second portion of the zone of unfragmented formation.

18. A method for forming a fragmented permeable mass of formation particles containing oil shale in an in situ oil shale retort in a subterranean formation containing oil shale, comprising the steps of:

(a) excavating at least an upper and a lower generally horizontally extending void in the subterranean formation, leaving an upper zone of unfragmented formation above the upper void, an intermediate zone of unfragmented formation comprising an upper portion and a lower portion between the upper and lower voids, and a lower zone of unfragmented formation below the lower void;

(b) loading the upper and lower zones of unfragmented formation with explosive for expanding the upper zone of unfragmented formation downwardly toward the upper void and for expanding the lower zone of unfragmented formation upwardly toward the lower void;

(c) loading the upper portion of the intermediate zone of unfragmented formation with explosive for expanding the upper portion upwardly toward the upper void and loading the lower portion of the intermediate zone of unfragmented formation with explosive for expanding the lower portion downwardly toward the lower void, the powder factor in one of the portions being higher than the powder factor in the other portion;

(d) detonating the explosive in a single round comprising the steps of:

(i) detonating the explosive in the upper zone for expanding the upper zone downwardly toward the upper void;

(ii) detonating explosive in the intermediate zone for expanding the upper portion of the intermediate zone upwardly toward the upper void and expanding the lower portion of the intermediate zone downwardly toward the lower void; and (iii) detonating explosive in the lower zone for expanding the lower zone upwardly toward the lower void, the unfragmented formation expanded forming horizontal layers of formation particles comprising the fragmented permeable mass of formation particles in the retort, a first layer of formation particles formed from the upper zone of unfragmented formation, a second layer of formation particles formed from the upper portion of the intermediate zone of unfragmented formation, a third layer of formation particles formed from the lower portion of the intermediate zone of unfragmented formation, and a fourth layer of formation particles formed from the lower zone of unfragmented formation, the effective average void fraction of the layer of formation particles formed from the portion of the intermediate zone with a higher powder factor being higher than the effective average void fraction of adjacent layers of formation particles.

19. The method according to claim 18 wherein the volume of the upper zone of unfragmented formation plus the volume of the upper portion of the intermediate zone of unfragmented formation is about equal to the volume of the lower zone of unfragmented formation plus the lower portion of the intermediate zone of unfragmented formation and the volume of the first void is different from the volume of the second void.

20. The method according to claim 18 wherein the volume of the first and second voids is about equal and the volume of the upper portion of the intermediate zone of unfragmented formation is about equal to the volume of the lower portion of the intermediate zone of unfragmented formation.

21. A method for forming a fragmented permeable mass of formation particles containing oil shale in an in situ oil shale retort in a subterranean formation containing oil shale comprising the steps of:

(a) excavating at least an upper and a lower generally horizontally extending void in the subterranean formation, leaving an upper zone of unfragmented formation above the upper void, an intermediate zone of unfragmented formation between the upper and lower voids, and a lower zone of unfragmented formation below the lower void;

(b) forming an array of substantially vertical columnar explosive charges in the upper zone of unfragmented formation;

(c) forming an array of substantially vertical columnar explosive charges in the lower zone of unfragmented formation;

(d) forming first and second vertically spaced apart arrays of substantially vertical columnar explosive charges in the intermediate zone of unfragmented formation, the first array for expanding a first portion of the intermediate zone of unfragmented formation toward one of the voids and the second array for expanding a second portion of the intermediate zone of unfragmented formation upwardly toward the upper void and downwardly toward the lower void, the first portion being smaller than the second portion;

(e) detonating explosive charges in a single round comprising the steps of:

(i) detonating the array of explosive charges in the upper zone for explosively expanding the upper zone of unfragmented formation downwardly toward the upper void;

(ii) detonating the array of explosive charges in the lower zone for explosively expanding the lower zone of unfragmented formation upwardly toward the lower void; and (iii) detonating the first array of explosive charges in the intermediate zone for expanding the first portion of the intermediate zone toward one of the voids and thereafter detonating the second array of explosive charges in the intermediate zone for explosively expanding the second portion of the intermediate zone upwardly toward the upper void and downwardly toward the lower void, the unfragmented formation expanded forming horizontal layers of formation particles comprising the fragmented permeable mass of formation particles in the retort, the effective average void fraction of the layer of formation particles formed by expansion of the first portion of the intermediate zone of unfragmented formation being higher than the effective average void fraction of adjacent layers.

* * * * *

UNITED STATES PATENT AND TRADEMARK OFFICE

CERTIFICATE OF CORRECTION

PATENT NO. : 4,359,246

DATED : November 16, 1982

INVENTOR(S) : Thomas E. Ricketts

It is certified that error appears in the above-identified patent and that said Letters Patent are hereby corrected as shown below:

Column 2, line 21, "4,943,595" should be -- 4,043,595 --.

Column 4, line 66, -- space -- should be inserted after "void" and before "decreases".

Column 5, line 25, -- void -- should be inserted after "high" and before "fraction".

Column 7, line 35, "comubstion" should be -- combustion --.

Column 18, line 33, -- mass -- should be inserted after "fragmented" and before "for".

Signed and Sealed this

First Day of March 1983

[SEAL]

*Attest:*

GERALD J. MOSSINGHOFF

*Attesting Officer*

*Commissioner of Patents and Trademarks*